US005483032A

United States Patent [19]

Trayer et al.

[11] Patent Number: 5,483,032

[45] Date of Patent: Jan. 9, 1996

[54] HIGH VOLTAGE LOAD INTERRUPTER WITH SAFETY SYSTEM

[76] Inventors: Frank C. Trayer, 25690 La Lanne Ct.; John P. Trayer, 25851 Vinedo La., both of Los Altos Hills, Calif. 94022

[21] Appl. No.: 220,727

[22] Filed: Mar. 30, 1994

[51] Int. Cl.[6] ..... H01H 33/42; H01H 33/53; H01H 33/66; H01H 33/68

[52] U.S. Cl. ..... 218/91; 218/92; 218/100; 218/118

[58] Field of Search ..... 200/144 R, 144 B, 200/146 R, 147 R, 148 R, 148 A, 148 B, 150 R–150 G; 218/3, 5, 10, 12, 14, 69, 70, 91–116, 118, 119, 120, 121, 140, 144

[56] References Cited

U.S. PATENT DOCUMENTS

| | | | |
|---|---|---|---|
| 3,571,543 | 3/1971 | Perkins et al. | 200/144 B |
| 3,814,882 | 6/1974 | Harrold | 200/144 B |
| 4,087,664 | 5/1978 | Weston | 200/145 |
| 4,105,878 | 8/1978 | Date et al. | 218/10 |
| 4,283,610 | 8/1981 | Date et al. | 218/12 |
| 4,434,332 | 2/1984 | Yanabu et al. | 200/144 AP |
| 4,458,119 | 7/1984 | Hashimoto et al. | 200/145 |
| 4,814,559 | 3/1989 | Stegmuller | 200/145 |
| 4,972,055 | 11/1990 | Perulfi et al. | 200/144 B |

*Primary Examiner*—J. R. Scott
*Attorney, Agent, or Firm*—Schapp and Hatch

[57] ABSTRACT

A high voltage load interrupter including an oil switch and a vacuum switch, an oil switch operating handle for manual operation of the oil switch, and a vacuum switch operating handle for manual operation of the vacuum switch, in which the oil switch operating handle and the vacuum switch operating handle are so located with respect to each other that the oil switch operating handle cannot be moved to its "switch open" position unless the vacuum switch operating handle is in its "switch open" position and the vacuum switch operating handle cannot be moved to its "switch closed" position unless the oil switch operating handle is in its "switch closed" position.

4 Claims, 2 Drawing Sheets

HIGH VOLTAGE LOAD INTERRUPTER WITH SAFETY SYSTEM

BACKGROUND OF THE INVENTION

1. Field of the Invention

The present invention relates to high voltage electrical switchgear, and more particularly to high voltage load interrupters with safety systems.

2. Description of the Prior Art

Prior art high voltage load interrupters are generally of two types, viz., high voltage load interrupters which are oil immersed and which use oil as the interrupting medium (called herein "oil switches") and high voltage load or fault interrupters which are oil immersed and which use vacuum as the interrupting medium (called herein "vacuum switches").

The typical oil switch has the advantage that its contacts are visible through a window in the side of the oil-filled tank in which it is contained, and thus its operating state (open or closed) can be determined visually, insuring the safety of those who must work on the associated high voltage circuits.

However, as is well known in the prior art, arcing between the contacts of an oil switch carbonizes the oil in the tank, and after a small number of switch operations the carbonized oil becomes more and more opaque, ultimately reaching a state of opacity in which the contacts of the oil switch are no longer visible through the window in the tank wall.

Further, the carbonization of the oil in the tank produced by arcing between the contacts of the oil switch immersed therein creates explosive gasses and also reduces the insulation value of the oil.

Typically, the effective life of an oil switch is but a few hundred switch operations, i.e., interruptions, at most. A relatively few interruptions will carbonize the oil to such an extent that contacts are not visible.

As is also well known in the prior art, vacuum switches have many advantages over oil switches.

For example, the life of a vacuum switch is typically ten thousand operations. Further, since the arcing in a vacuum switch takes place inside a vacuum chamber, the surrounding insulating oil is not carbonized by this arcing.

However, vacuum switches have the disadvantage that their contacts are not visible through the window in the wall of the associated tank, due to the fact that the walls of the vacuum chambers containing the switch contacts are opaque.

A common safety practice of electric utility companies is to require that before a worker can work on a particular high voltage circuit that circuit must be isolated by a visible disconnect the contacts of which are directly viewable, and thus can be seen to be open.

As a result, the use of oil immersed vacuum switches has, in the past, required electrical utility companies to use hot stick removable terminations on high voltage cables in order to provide directly visible evidence of disconnection. However, the hot stick removal of such terminations is time-consuming, difficult, and in some cases results in failure of the insulating seals on the terminations when they are replaced on the switch bushings.

The term "prior art" as used herein or in any statement made by or on behalf of applicants means only that any document or thing referred to as prior art bears, directly or inferentially, a date which is earlier than the effective filing date hereof.

No representation or admission is made that a search has been made, or that no more pertinent information than that set out hereinabove exists.

SUMMARY OF THE INVENTION

Accordingly, it is an object of the present invention to provide high voltage load interrupters with safety systems which combine the direct contact viewability advantage of prior art oil switches with the long operating life advantage of prior art vacuum switches.

Another object of the present invention is to provide high voltage load interrupters with safety systems in which arcing between the switch contacts does not carbonize the associated insulating oil and thus does not opacify the associated insulating oil.

Yet another object of the present invention is to provide high voltage load interrupters with safety systems in which the oil switch contacts remain visible through a window in the wall of the tank containing the oil throughout an operating life comparable to the operating life of a typical vacuum switch.

A yet further object of the present invention is to provide high voltage load interrupters with safety systems which do not require the use of a hot stick to assure that a particular high voltage circuit is fully isolated and thus can be safely worked on.

Another object of the present invention is to provide high voltage load interrupters with safety systems which save time and labor costs and prevent termination failures due to disturbance of the cable terminations, and yet provide the personal safety advantage of directly visible contacts.

Other objects of the present invention will in part be obvious and will in part appear hereinafter.

The present invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of the present invention will be indicated in the appended claims.

In accordance with a principal feature of the present invention high voltage load interrupters with safety systems are provided which consist of both oil switches and vacuum switches in the same oil-filled tank.

In accordance with another principal feature of the present invention the vacuum switches and the oil switches located in the same oil-filled tank are connected in series.

In accordance with yet another principal feature of the present invention the mechanical switch operating means of said vacuum switches and said oil switches are mechanically interlocked so that the vacuum switches must open first and close last.

In accordance with an additional principal feature of the present invention the oil switches thereof are located behind a suitable window in the wall of the associated tank, thereby permitting direct viewing of the switch contacts to assure that the switch contacts are open and that thus the associated high voltage circuit is completely deenergized and safe for repair or replacement by human workers.

In accordance with a yet further principal feature of the present invention the interconnection of the vacuum switches and oil switches thereof is such that the oil switches are opened under load only in the very rare event that the associated vacuum switch malfunctions, and thus the oil in the tank is not carbonized and the visibility of the oil switch contacts remains very good.

In accordance with an additional principal feature of the present invention the high voltage load interrupters with safety systems of the present invention are provided with dual interlocking switch operating handles, the interlocking of which assures that the vacuum switch or switches are opened first and closed last during manual operation.

In accordance with a yet further principal feature of the present invention the high voltage load interrupters with safety systems of the present invention are adapted to remote control of the switches thereof thus adapting the high voltage load interrupters with safety systems of the present invention to current utility system practice, involving computerized daily switching to achieve economic line loading.

In accordance with an additional principal feature of the present invention the vacuum switch operating handles of certain of the high voltage load interrupters with safety systems of the invention are adapted to be coupled to commercially available remote control switch handle operators.

For a fuller understanding of the nature and objects of the present invention, reference should be had to the following detailed description, taken in connection with the accompanying drawings.

DESCRIPTION OF THE PREFERRED EMBODIMENT

Figure 1:
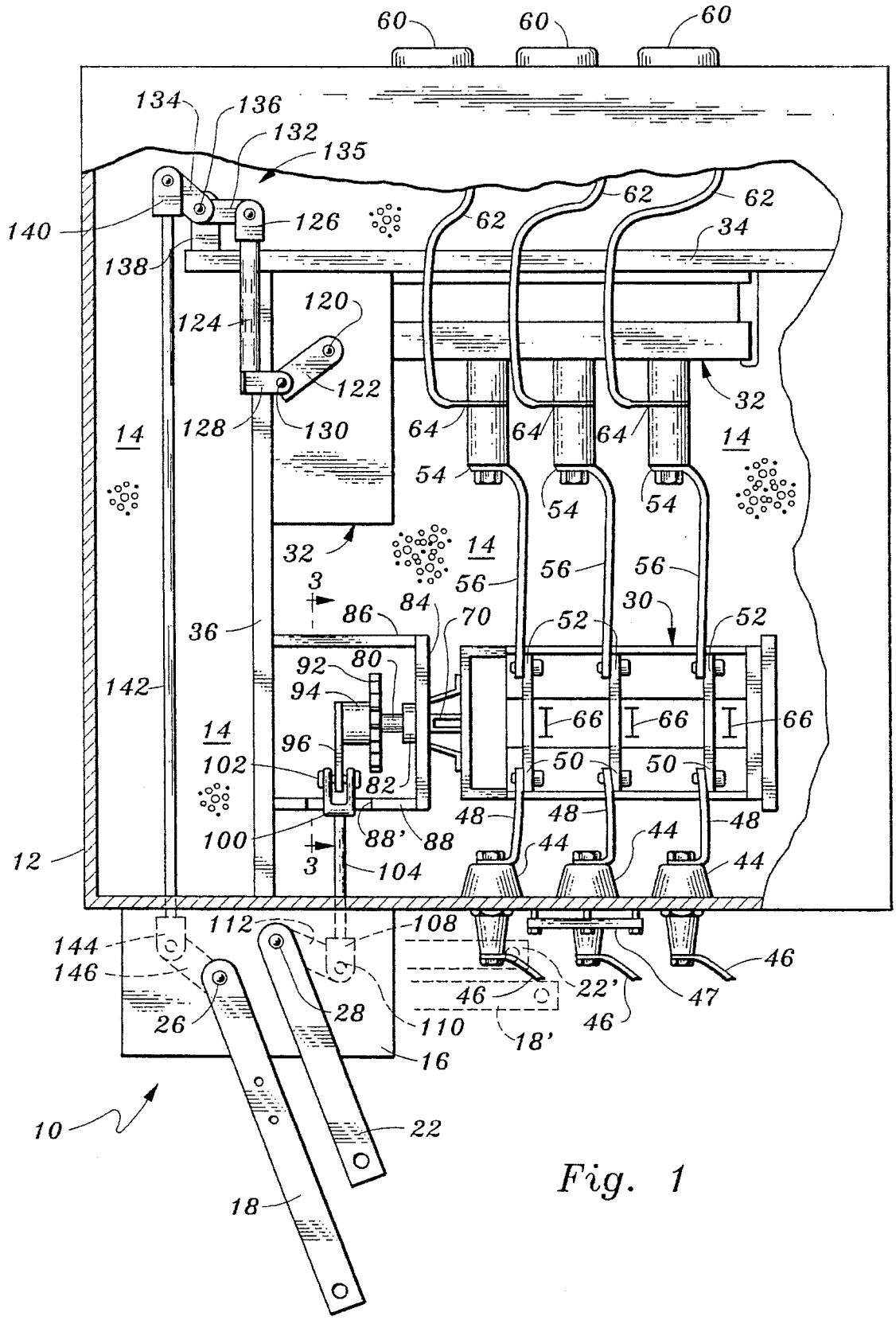
FIG. 1 is a plan view, partly in section, of a high voltage load interrupter with safety system constructed in accordance with the present invention.

Referring now to FIG. 1, there is shown a high voltage load interrupter with safety system 10 of the present invention.

It is to be understood that the scope of the present invention is by no means limited to the particular embodiment thereof which is shown in FIG. 1.

As seen in FIG. 1, high voltage load interrupter 10 includes a tank 12 containing a body 14 of insulating oil of the type well known for use in high voltage load interrupters and other high voltage switchgear.

Figure 2:
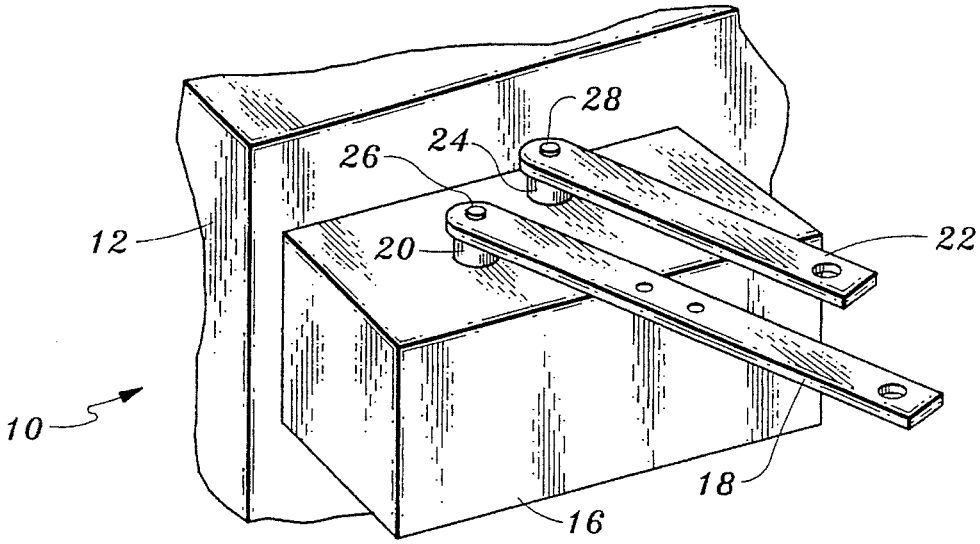
FIG. 2 is a perspective view of the portion of the high voltage load interrupter with safety system of the present invention shown in FIG. 1 which includes the two switch operating handles.

As best seen by comparison of FIGS. 1 and 2, tank 12 is provided with an outwardly projecting portion 16, sometimes called a "doghouse".

In the known manner, the interior of "doghouse" 16 is completely open to and in communication with the interior of tank 12, and thus contains a portion of the body 14 of insulating oil.

As may also be seen by comparison of FIGS. 1 and 2, a switch operating handle 18, sometimes hereinafter called the "vacuum switch operating handle", is pivotably mounted on a bearing 20 which passes through the top of "doghouse" 16.

As may further be seen by comparison of FIGS. 1 and 2, an additional switch operating handle 22, sometimes hereinafter called "oil switch operating handle", is pivotably mounted on a bearing 24 which passes through the top of "doghouse" 16.

Again comparing FIGS. 1 and 2, it will be seen that switch handle 18 is affixed to the upper end of a stub shaft 26 which passes through bearing 20 and switch handle 22 is affixed to the upper end of a stub shaft 28 which passes through bearing 24.

The lower end of stub shaft 26 is contained within "doghouse" 16, and the lower end of stub shaft 28 is contained within "doghouse" 16.

As seen in FIG. 1, oil switch operating handle 22 is manually operable between its outer or "switch open" position (shown in solid lines and identified by the reference numeral 22) and its inner or "switch closed" position (shown in dashed lines and identified by the reference numeral 22').

Similarly, as further seen in FIG. 1, vacuum switch operating handle 18 is operable between its outer or "switch open" position (shown in solid lines and identified by the reference numeral 18) and its inner or "switch closed" position (shown in dashed lines and identified by the reference numeral 18').

As best seen in FIG. 2, switch operating handles 18 and 22 lie in the same plane, and thus switch operating handle 22 cannot be moved to its "switch open" position unless switch operating handle 18 is in its "switch open" position; and switch operating handle 18 cannot be moved to its "switch closed" position (dashed lines, FIG. 1) unless switch operating handle 22 is in its "switch closed" position (dashed lines, FIG. 1).

Referring again to FIG. 1 it will be seen by those having ordinary skill in the art, informed by the present disclosure, that tank 12 contains a three-phase oil switch 30 and a three-phase vacuum switch 32.

Three-phase oil switch 30 is a three deck Type LBOR-II load break oil immersed switch made and sold by the ABB Power T & D Company, Inc., Components Division, Nashville, Tenn. 37210.

Three-phase vacuum switch 32 is a Slave/Master Toggle Mechanism made by the Trayer Engineering Corporation of San Francisco, Calif., which is a sub-assembly of several types of switchgear made and sold thereby.

As hereinafter described in detail, oil switch 30 can be operated between its open and closed positions by switch operating handle 22, and vacuum switch 32 can be operated between its open and closed positions by switch operating handle 18.

As will be understood by those having ordinary skill in the art, informed by the present disclosure, oil switch 30 and vacuum switch 32 are both secured to the walls of tank 12 in such manner as to be immovable with respect thereto.

In particular, vacuum switch 32 is supported on partitions 34 and 36 which are located within tank 12.

As will also be understood by those having ordinary skill in the art, informed by the present disclosure, body 14 of insulating oil is of sufficient depth to completely submerge both oil switch 30 and vacuum switch 32. Oil switch 30 is supported at east in part, and the mechanism for operating oil switch 30 is supported, by partition 36.

As further seen in FIG. 1, three high voltage bushings 44 pass through the front wall of tank 12 below a window 47.

Three high voltage electrical conductors 46 are attached to the outer ends of bushings 44, and are themselves, mediately or immediately, connected to a three-phase alternating current high voltage power line.

Three bus bars or straps 48 are provided, whereby each bushing 44 is connected to a corresponding terminal 50 of oil switch 30.

Each of the remaining terminals of oil switch 30, hereinafter designated by the reference numeral 52, is connected to a corresponding terminal 54 of vacuum switch 32 by means of a bus bar or strap 56.

As further indicated in FIG. 1, three vacuum fuse wells 60 are mounted in the rear wall of tank 12. Vacuum fuse wells 60 may be of the type shown and described in U.S. Pat. No. 4,170,000, issued to Frank C. Trayer on Oct. 2, 1979. Mounted in each vacuum fuse well 60 in the manner taught in U.S. Pat. No. 4,170,000 is a vacuum fuse, such as a Type VF vacuum fuse made and sold by the McGraw-Edison Company, or a current limiting fuse such as the type SX made and sold by The Combined Technologies Company.

While the preferred embodiment of the invention includes three fuse wells 60, it is to be understood that the present invention is not limited in its scope to devices including such fuse wells.

Rather, the present invention also embraces devices of the type shown and described herein wherein the fuse wells 60 are replaced by bushings similar to bushings 46, or with other terminal arrangements.

As further seen in FIG. 1, each fuse well 60 is connected to an output terminal 64 of vacuum switch 32 by means of a strap or bus 62.

As yet further seen in FIG. 1, oil switch 30 includes three sets 66 of switch contacts, represented only schematically in FIG. 1.

As is well known to those having ordinary skill in the art, and familiar with the Type LBOR-II load break oil immersed switch, switch contact sets 66 are all visible from outside oil switch 30, and thus are all visible through window 47 in the wall of tank 12, so long as insulating oil 14 does not become opacified.

As is also well known to those having ordinary skill in the art, oil switch 30 is provided with a stub shaft 70 by the rotating of which the contacts of oil switch 30 may be operated between their open and closed positions.

Figure 3:
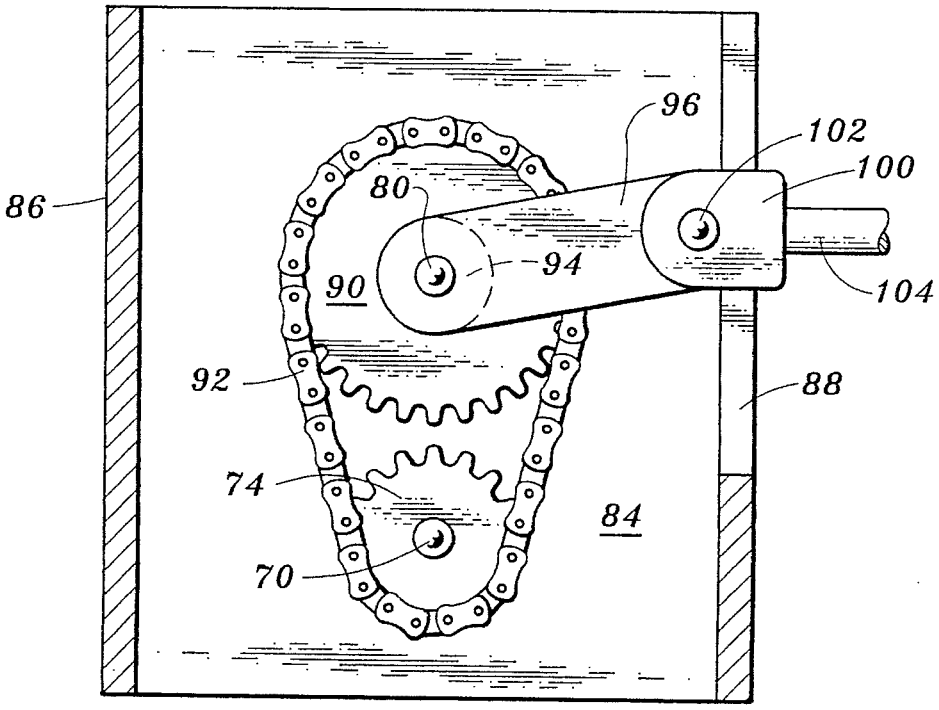
FIG. 3 is a partial view of the oil switch operating means of the high voltage load interrupter with safety system of the present invention shown in FIGS. 1 and 2, taken on plane 3—3 of FIG. 1.

As seen in FIG. 3, a sprocket 74 is irrotatably affixed to oil switch operating stub shaft 70.

As seen in FIG. 1, a stub shaft 80 is rotatably mounted in a bearing 82 which is itself affixed to plate 84.

Plate 84 is affixed to partition 36 by means of side plates 86, 88.

Returning to FIG. 3, it will be seen that a sprocket 90 is irrotatably affixed to stub shaft 80.

It will also be seen by those having ordinary skill in the art, informed by the present disclosure, that sprockets 74 and 90 are coupled together by a coacting drive chain 92. Alternatively, sprockets 74 and 90 may be coupled together by a system of bell cranks.

As will be understood by those having ordinary skill in the art, informed by the present disclosure, comparing FIGS. 1 and 3, a cylindrical boss 94 and a crank arm 96 are both provided with bores which tight-fittingly receive stub shaft 80.

Cylindrical boss 94 is affixed to sprocket 90, and is also affixed to crank arm 96.

Both cylindrical boss 94 and crank arm 96 are irritably affixed to stub shaft 80, which is itself rotatably journaled in bearing 82 (FIG. 1).

Thus, it will be evident to those having ordinary skill in the art, informed by the present disclosure, that whenever crank arm 96 is rotated through a particular angle about the axis of stub shaft 80 stub shaft 70 is correspondingly rotated about its own axis by an angle greater than the angle through which crank arm 96 is rotated.

Thus, when crank arm 96 is rotated about the axis of shaft 80 through an angle of 70', operating stub shaft 70, which operates the contacts of oil switch 30 between their open and closed positions, is correspondingly operated through the necessary angle to effect switch opening and closing.

As may further been seen by comparison of FIGS. 1 and 3, crank arm 96 is provided at its outer end with a clevis 100 the pin 102 of which passes through a loose-fitting hole in the outer end of crank arm 96.

A push rod 104 is affixed to the cross plate portion of clevis 100 which passes through a notch 88' in plate 88.

As seen in FIG. 1, a clevis 108 is affixed to the outer end of push rod 104, and the pin 110 of clevis 108 passes through a hole in bell crank arm 112.

Bell crank arm 112 is irritably affixed to the inner end of stub shaft 28, the outer end of which is irritably affixed to oil switch operating handle 22.

Thus, it will be evident to those having ordinary skill in the art, informed by the present disclosure, that oil switch operating arm 22 is so coupled to operating stub shaft 70 of oil switch 30 that oil switch 30 can be operated from its fully closed position to its open position, and vice versa, by manipulating oil switch operating handle 22.

More particularly, the linkage between switch operating handle 22 and oil switch operating shaft 70 is so constructed and arranged that when handle 22 is in its outermost position as shown in solid lines in FIG. 1, oil switch 30 is in its fully open position, and when handle 22 is in its innermost position 22' shown in dashed lines in FIG. 1, oil switch 30 is closed.

As is also well known to those having ordinary skill in the art, vacuum switch 32 is provided with a stub shaft 120 by the rotating of which the contacts of vacuum switch 32 may be operated between their open and closed positions.

As seen in FIG. 1, a crank arm 122 is irritably affixed to the outer end of stub shaft 120, so that vacuum switch 32 can be opened or closed by suitably rotating crank arm 122 about the axis of stub shaft 120.

Also shown in FIG. 1 is a rigid link 124 to one end of which is affixed a clevis 126 and to the other end of which is affixed a perpendicularly disposed pivot arm 128.

Pivot arm 128 is pivotably joined to crank arm 122 by means of a suitable pivot pin 130.

As also seen in FIG. 1, clevis 126 is pivotably affixed, in the well known manner, to the outer end of a bell crank arm 132.

Bell crank arm 132 is affixed to a bell crank arm 134 for joint rotation about the axis of a pivot pin 136. Bell crank arm 132 and bell crank arm 134 will sometimes hereinafter be collectively referred to as bell crank 135.

Bell crank 135 is pivotably mounted on pivot pin 136 the inner end of which (remote from the viewer in FIG. 1) is affixed to the outer end of a pivot support arm 138.

As also seen in FIG. 1, pivot support arm 138 is affixed to partition 34.

A clevis 140 is pivotably affixed to the outer end of bell crank arm 134.

As also seen in FIG. 1, a rigid pushrod 142 is affixed to the crossplate of clevis 140.

The opposite end of pushrod 142 is affixed to the cross-plate of a clevis 144 which is located inside "doghouse" 16.

Clevis 144 is pivotably affixed in the well known manner to the outer end of crank arm 146, which is also located inside of "doghouse" 16.

The inner end of crank arm 146 is irritably affixed to stub shaft 26, as is switch operating handle 18.

As will be evident to those having ordinary skill in the art, informed by the present disclosure, and particularly by the description of the linkage extending between switch operating handle 18 and stub shaft 120 of vacuum switch 32, vacuum switch 32 can be operated between its open state and its closed state by manipulation of switch operating handle 18.

Thus, vacuum switch 32 will be in its open condition whenever switch operating handle 18 is in its outer position (shown in solid lines in FIG. 1), and will be in its closed condition whenever switch operating handle 18 is in its inner position (shown in dashed lines in FIG. 1 and referred to by reference numeral 18').

Since, as shown in FIG. 2, switch operating handles 18 and 22 lie in the same plane, it will be seen by those having ordinary skill in the art, informed by the present disclosure, that oil switch operating handle 22 cannot be moved to its "switch open" position unless vacuum switch operating handle 18 is in its "switch open" position, and vacuum switch operating handle 18 cannot be moved to its "switch closed" position (dashed lines, 18', FIG. 1) unless oil switch operating handle 22 is in its "switch closed" position (dashed lines, 22', FIG. 1).

It will thus be seen that the objects set forth above, among those made apparent from the preceding description, are efficiently attained, and since certain changes may be made in the above constructions and the methods carried out thereby without departing from the scope of our present invent/on, it is intended that all matter contained in the above description or shown in the accompanying drawings shall be interpreted as illustrative only, and not in a limiting sense.

It is also to be understood that the following claims are intended to cover all of the generic and specific features of our invention hereindescribed, and all statements of the scope of our invention which, as a matter of language, might be said to fall therebetween.

What is claimed is:

1. A high-voltage load interrupter, comprising:

a tank containing a body of insulating oil;

an oil switch fixedly positioned in said tank and contained in said body of insulating oil;

a vacuum switch fixedly positioned in said tank;

a first stub shaft pivotably mounted in a first fluid-tight bearing which is itself fluid-tightly mounted in a wall of said tank;

a second stub shaft pivotably mounted in a second fluid-tight bearing which is itself fluid-tightly mounted in said wall of said tank;

a first switch operating handle affixed to the outer end of said first stub shaft and located outside of said tank;

a second switch operating handle affixed to the outer end of said second stub shaft and located outside of said tank;

first coupling means for coupling the inner end of said first stub shaft to said oil switch, whereby said oil switch may be operated between its open and closed positions by manipulating said first switch operating handle;

second coupling means for coupling the inner end of said second stub shaft to said vacuum switch, whereby said vacuum switch may be operated between its open and closed positions by manipulating said second switch operating handle;

said first and second switch operating handles being so juxtaposed when both are in their switch-closed positions that part of said second switch operating handle lies in the path of movement of part of said first switch operating handle and thus said first switch operating handle cannot be moved to its oil switch open position without moving said part of said second switch operating handle out of the path of said first switch operating handle.

2. A high-voltage load interrupter as claimed in claim 1 in which said first and second switch operating handles are so juxtaposed that when both are in their switch-open positions at least part of said first switch operating handle lies in the path of movement of at least part of said second switch operating handle and thus said second switch operating handle cannot be moved from its vacuum switch open position to its vacuum switch closed position without first moving said first switch operating handle out of the path of said second switch operating handle.

3. A high-voltage load interrupter as claimed in claim 1 in which said wall of said tank is a horizontal wall of a portion of said tank projecting from the main body of said tank.

4. A high-voltage load interrupter as claimed in claim 3 in which said horizontal wall is the top of said projecting portion of said tank.

* * * * *